US009540891B2

(12) United States Patent
Milivojevic et al.

(10) Patent No.: US 9,540,891 B2
(45) Date of Patent: Jan. 10, 2017

(54) DEVICE AND METHOD FOR HANDLING DRILL STRING COMPONENTS AND DRILL RIG

(75) Inventors: Misel Milivojevic, Åkersberga (SE); Ola Sylván, Trångsund (SE); Mats Idoff, Bromma (SE); Björn Rundlöf, Upplands-Väsby (SE); Johan Broström, Örebro (SE); Örjan Säker, Örebro (SE); Martin Ahlström, Tyresö (SE)

(73) Assignee: ATLAS COPCO CRAELIUS AB, Märsta (SE)

( * ) Notice: Subject to any disclaimer, the term of this patent is extended or adjusted under 35 U.S.C. 154(b) by 612 days.

(21) Appl. No.: 13/641,300

(22) PCT Filed: Apr. 13, 2011

(86) PCT No.: PCT/SE2011/050453

§ 371 (c)(1),
(2), (4) Date: Oct. 15, 2012

(87) PCT Pub. No.: WO2011/129760

PCT Pub. Date: Oct. 20, 2011

(65) Prior Publication Data

US 2013/0037324 A1 Feb. 14, 2013

(30) Foreign Application Priority Data

Apr. 14, 2010 (SE) ..... 1000381

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/155; E21B 19/20
See application file for complete search history.

(56) References Cited

U.S. PATENT DOCUMENTS 4,280,785 A * 7/1981 Albrecht ..... 414/735
4,449,592 A * 5/1984 Mayer ..... 175/52
(Continued)

FOREIGN PATENT DOCUMENTS

WO WO-98/55728 A1 12/1998
WO WO-2007/115375 A1 10/2007
WO WO-2011/065193 6/2011

OTHER PUBLICATIONS

PCT/ISA/210—International Search Report—July 11, 2011—Issued in PCT/SE2011/050453.
(Continued)

*Primary Examiner* — Blake Michener
(74) *Attorney, Agent, or Firm* — Venable, LLP

(57) ABSTRACT

A device for handling drill string components for a drill rig. A slide is arranged displaceable on a longitudinal guide. A grip unit is swingable between a first position for receiving and delivering of drill string components beside the drill rig and a second position for assembling and disassembling of drill string components in the drill rig. The grip unit includes a rotator unit for rotation of a gripped drill string component. A rotational actuator supported by the slide has a rotational axis forming an angle with the length guide. A swing unit includes a first link portion that is connected to the rotational axis. A second link portion is connected to the grip unit and a swing joint portion.

18 Claims, 11 Drawing Sheets

(56) References Cited

U.S. PATENT DOCUMENTS

| | | | | |
|---|---|---|---|---|
| 4,718,805 | A | 1/1988 | Becker | |
| 5,050,283 | A | 9/1991 | Piipponen et al. | |
| 5,458,454 | A * | 10/1995 | Sorokan | 414/800 |
| 5,941,324 | A * | 8/1999 | Bennett | 175/85 |
| 6,085,852 | A * | 7/2000 | Sparks et al. | 175/52 |
| 6,634,443 | B1 * | 10/2003 | Paech et al. | 175/85 |
| 6,845,825 | B2 * | 1/2005 | Bischel et al. | 175/24 |
| 7,347,285 | B2 * | 3/2008 | Hamner | 175/122 |
| 8,186,925 | B2 * | 5/2012 | Littlely | 414/22.55 |
| 8,910,719 | B2 * | 12/2014 | Kockeis et al. | 166/380 |
| 2005/0061548 | A1 | 3/2005 | Hooper et al. | |
| 2009/0238663 | A1 * | 9/2009 | Littlely | 414/22.54 |
| 2012/0202607 | A1 | 8/2012 | Fujio | |

OTHER PUBLICATIONS

PCT/ISA/237—Written Opinion of the International Searching Authority—July 11, 2011—Issued in PCT/SE2011/050453.

* cited by examiner

DEVICE AND METHOD FOR HANDLING DRILL STRING COMPONENTS AND DRILL RIG

CROSS-REFERENCE TO RELATED APPLICATIONS

This application claims priority under 35 U.S.C. §119 to Swedish patent application 1000381-2 filed 14 Apr. 2010 is the national phase under 35 U.S.C. §371 of PCT/SE2011/050453 filed 13 Apr. 2011.

FIELD OF THE INVENTION

The invention concerns a device for handling drill strings component. The invention also concerns a method for handling drill string components and a drill rig.

BACKGROUND OF THE INVENTION

During rock drilling of long drill holes, it is necessary to join a plurality of drill strings component for forming a drill string. During core drilling aiming to extract a drill core, it is often drilled to very great depths and distances. As an example it is common with drill holes measuring thousands of meters. The aim of core drilling is to investigate the rock ground at a distance in order, among other things, to determine the conditions for extracting minerals.

Core drilling is preformed with the aid of a rotating drill bit being driven by a rock drilling machine in the form of a rotational unit being arranged of a drill rig. During the rotational operation of the rotation unit, the rock drilling machine is simultaneously fed forwardly in the drilling direction through a feed mechanism being arranged on a linear guide, such as a feed beam.

In practice, a great part of the handling of the drill string components, which in the case of core drilling are tubular elements, is made manually, which results in a number of problems. Because of the often substantial weight of the components and that the handling position on the drill rig is difficult to access, the manual handling puts strain of the operator, also if it is preformed appropriately. It should be added that there is a risk of the operator being injured in connection with the handling. Further, the manual handling may lead to damaged drill string components and in particular their threaded portions because of intentional or unintentional careless handling of the elements.

Because of a manual handling being relatively slow and that the time when the drill rig stands still is relatively long, seen over a drilling sequence, the effectiveness of the rig is affected in a negative direction.

From U.S. Pat. No. 6,634,443 is previously known a device for handling drill string components, which, however, is complicated and requires positioning, which increases the problems with accessibility in connection with the basically manual handling of extracted drill cores.

AIM AND MOST IMPORTANT FEATURES OF THE INVENTION

It is an aim of the present invention to provide a device as mentioned initially, wherein the above problem are addressed and at least reduced.

This is achieved in that a rotational actuator being supported by the slide has an axis of rotation extending along a rotational axis and forming an angle to a longitudinal axis of the length guide. A swing unit includes a first link portion which is connected to said rotational axis, a second link portion which is connected to the grip unit and a swing joint portion, which interconnects said first and second link portions. The swing joint portion provides swinging of a gripped drill string component with the second drill portion and the grip unit around an axis which is parallel to the drill string component. When the device is in position for swinging-in the grip unit with (or also without) gripped drill string component into the drill rig, this axis is also parallel to the rotation axis of the drilling machine and the drill string rotated thereby.

Hereby is obtained an advantageous movement pattern for the grip unit to be achieved in a logical and simple manner, which results in that the device can be positioned in such a way in respect of a drill rig that handling of extracted drill cores is not unnecessary prohibited or made more difficult.

With the feature that the swing joint portion couples said first and second link portions, is intended that the first and second link portions are interconnected through this coupling. This makes it possible to swing the second link portion in respect of the first link portion around a swing axis of the swing joint portion.

The device according to the invention is valuable in order to reduce time for and increase operator security during joining and disassembling of drill string components during the drilling process, which includes exchange of drill bits which is required regularly during drilling, and which means that the entire drill string has to be extracted from the drill hole.

Altogether is obtained that besides effective drill string handling, also the important core handling work can be preformed with minimized risk for the operator and with the possibility of higher effectiveness and thereby shorter standstills for the equipment at a hole.

By having, as in an embodiment of the invention, a resilient portion arranged between the slide and the grip unit, relative movement between the slide and the grip unit is allowed in directions in parallel with an axial direction of a gripped drill string component. This is an advantage when the grip unit is swung to the second position in connection with threading together and threading apart of drill string components, since it in a simple and effective way allows that an adapted movement pattern will be imparted to the gripped drill string component during its threading onto and threading apart from the rest of the drill string.

It is preferred that the axis of rotation of the rotational actuator extends at a right angle to the longitudinal axis of the longitudinal guide.

In an embodiment of the invention, the swing unit is constructed as a rectangular frame having side elements of the frame comprising frame parts, wherein the first link portion includes a first frame part extending transversely to said axis of rotation and the second link portion includes two sideward frame parts and a transverse frame part. Hereby the swing joint portion includes two pivot pins extending from the first frame part thereof at least one of which being capable of being actuated by means of a rotator unit.

In a preferred variant of the invention, the second link portion is swingable such that the swing joint portion and the grip unit are on each side of the rotational actuator in said second position.

The construction as a frame allows preferably that the second link portion is swung such that it surrounds the rotational actuator in said second position.

The second link portion is suitably length-adjustable for fine adjustment to actual position in the drill rig.

It is preferred i.a. for stability reasons, that the resilient portion is arranged between the second link portion and a body part belonging to the grip unit.

It is preferred also that the resilient portion includes a linear guide and a spring pack acting between the second link portion and said body part.

In a preferred variant of the invention said rotation means is provided with a plurality of support rollers for cooperating with a gripped drill string component, whereof at least one can be actuated, the axis of which being parallel to an axial direction of a gripped drill string component. Though this arrangement, the gripped drill string component is imparted only a rotational direction by way of the rotation of these support rollers.

In particular, the device according to the invention is adapted for handling drill pipes for core drilling.

Suitably the device includes a control unit, which is interconnected with at least anyone from the group: position sensor and rotation sensor, for detecting positions taken by moveable components and for initiating control sequences with the aid thereof.

It is also referred to the document U.S. Pat. No. 4,403,666, which relates to resiliently mounted grippers for drill string components.

BRIEF DESCRIPTION OF DRAWINGS

The invention will now be described in more detail by way of embodiments and with reference to the annexed drawings, wherein:

FIGS. 1*a-d* show a drill rig with a device for handling drill string components according to the invention in the same perspective view but in different positions for transferring a drill string component to the rig, FIGS. 2*a-d* show the device in FIGS. 1*a-d* separated from the drill rig in corresponding views and in greater scale.

DESCRIPTION OF EMBODIMENTS

Figure 1A:
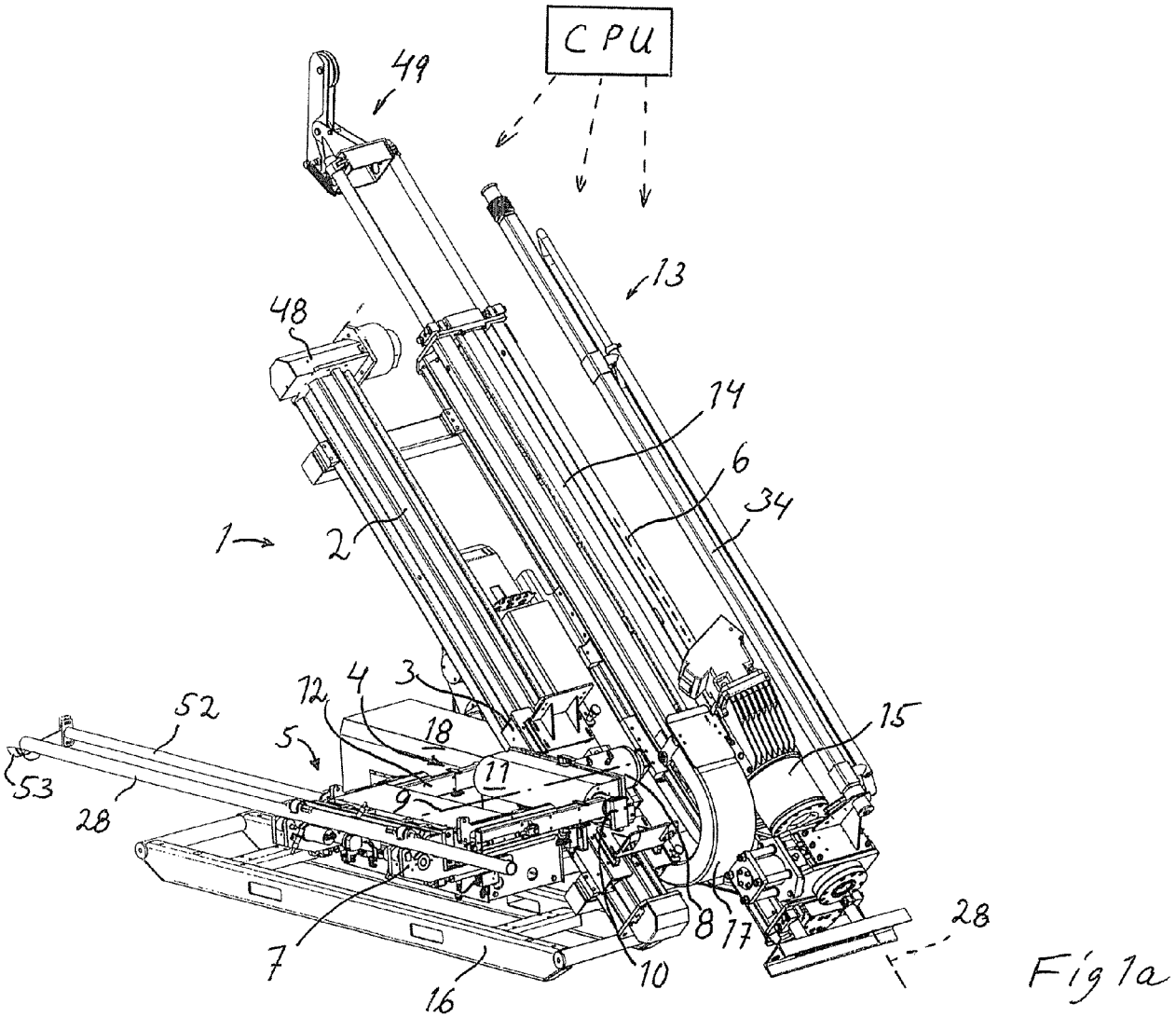
Figure 16:
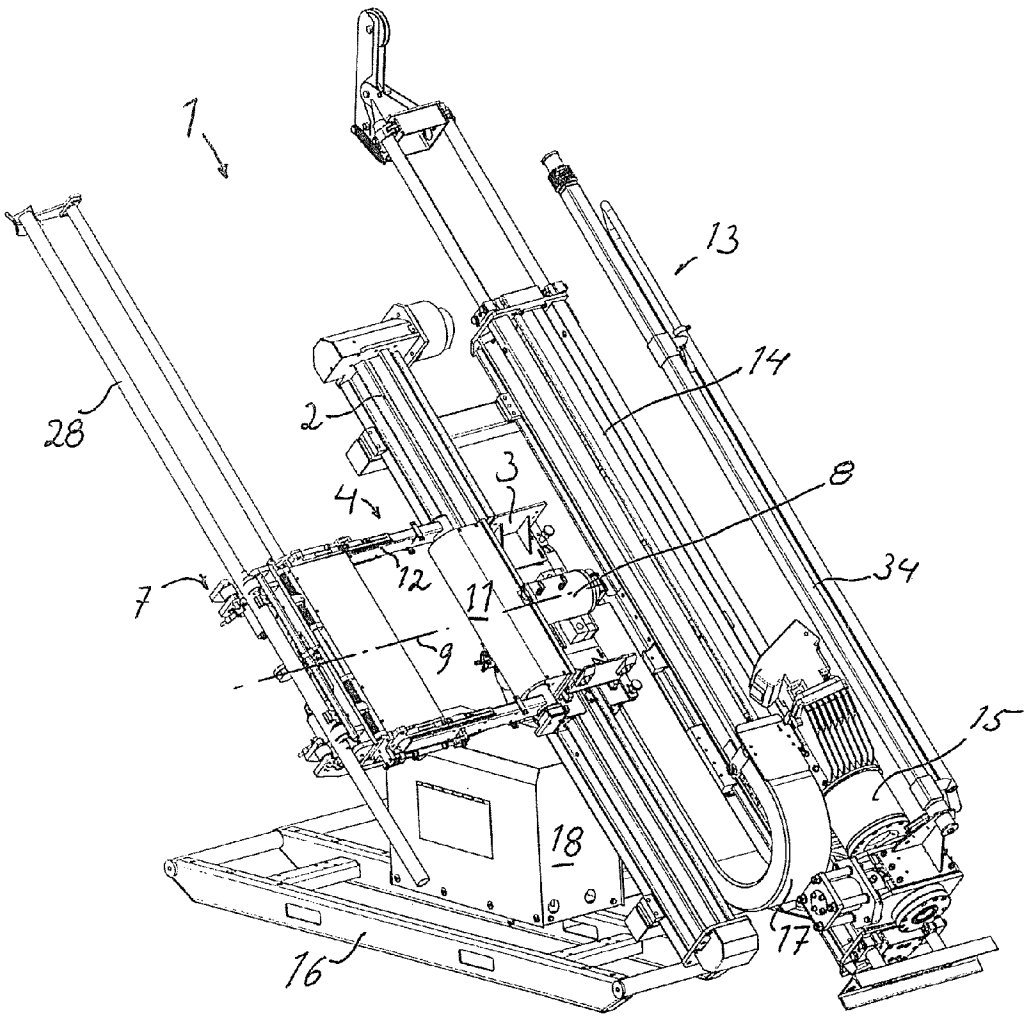

In FIG. 1*a* is shown a device for handling drill components 1 arranged in connection with a drill rig 13 for core drilling. The device 1 includes a length guide 2, which is parallel to the linear guide 14 of the drill rig 13.

On the length guide 2 there is a slide 3, which can be driven to and fro, and which carries a rotational actuator 8, the axis of rotation 9 of which being perpendicular to a length axis of the length guide 2. The length guide 2 is shown arranged sideward of said linear guide 14 for the drilling operation and both guides are shown being arranged in parallel planes. The slide 3 which carries the rotational actuator 8, runs sideways of a drilling machine slide for a drilling machine 15 of the rig.

The side by side arrangement of the guides in respect of each other allows the rotational actuator and the swing unit to be arranged more closely to the linear guide of the drilling machine and the position for assembling and disassembling of drill string components in the drill rig. It is to be understood that this allows that a axis of rotation 9 of the rotational actuator 8 in an advantageous way is arranged at a distance from each one of the guides in an outward direction, as seen from the free sides of the guides, which here normally means the side of the respective guide where the respective slide runs. In the shown embodiment, the axis of rotation 9 is arranged in parallel with a plane through a linear guide 14. In the shown embodiment, the axis of rotation 9 is also arranged in parallel with the plane through the length guide 2. Normally, and which is disclosed in the Figures, the axis of rotation 9 is essentially horizontally directed, in use of the rig.

To an outgoing rotational axis (not shown) of the rotational actuator 8 is connected a swing unit 4, which includes a swing joint portion being indicated with 10 and which interconnects or couples a first link portion being indicated with 11 and a second link portion 12 of the swing unit 4. By the first and second link portions being interconnected through this coupling to the swing joint portion, it will be possible to swing the second link portion in respect of the first link portion around a swing axis S of the swing joint portion. See FIG. 2*a*. This is made possible also with the above described side by side arrangement of the length guide 2 with the linear guide 14 and with the arrangement of the positioning of the rotational actuator on the slide so that its axis of rotation 9 is positioned at a distance from the respective guide.

The first link portion 11 is rigidly connected to said rotational axis.

At the distal, free, region of the swing unit 4 there is arranged a grip unit 7 for receiving and holding drill string components 28, which are to be transferred from a first position for receiving and delivering of drill string components beside the drill rig, which is the position that is shown in FIG. 1*a* and is indicated with reference number 5.

From this first position 5 the swing unit 4 is swingable to a second position for assembling and disassembling of the drill string components in the drill rig, said second position being illustrated with reference number 6 and being illustrated with an interrupted line in FIG. 1*a*.

During the swing movement there is on the one hand a rotation from the first position 5, which position in FIG. 1*a* shown as a horizontal loading position for a drill string component, into a position parallel to the drill string in the drill rig. This movement component is performed by the rotational actuator 8 rotating the swing unit 4 and the grip unit 7.

FIG. 1*b* shows the device after rotation through the rotational actuator 8 to a position in parallel with the drill string in the drill rig having been completed. In FIG. 1*b* there has also been performed a linear displacement of the slide 7 along the length guide 2 in the direction of an upper end thereof.

Figure 1C:
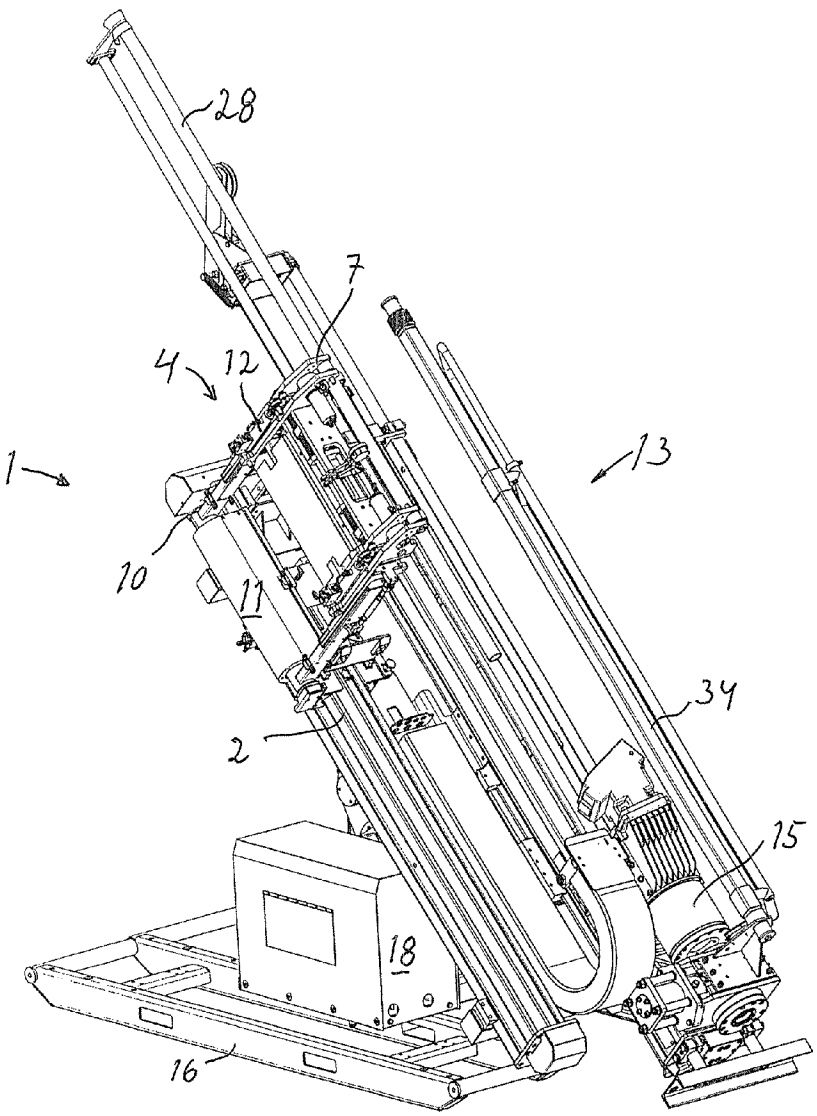
Figure 7D:
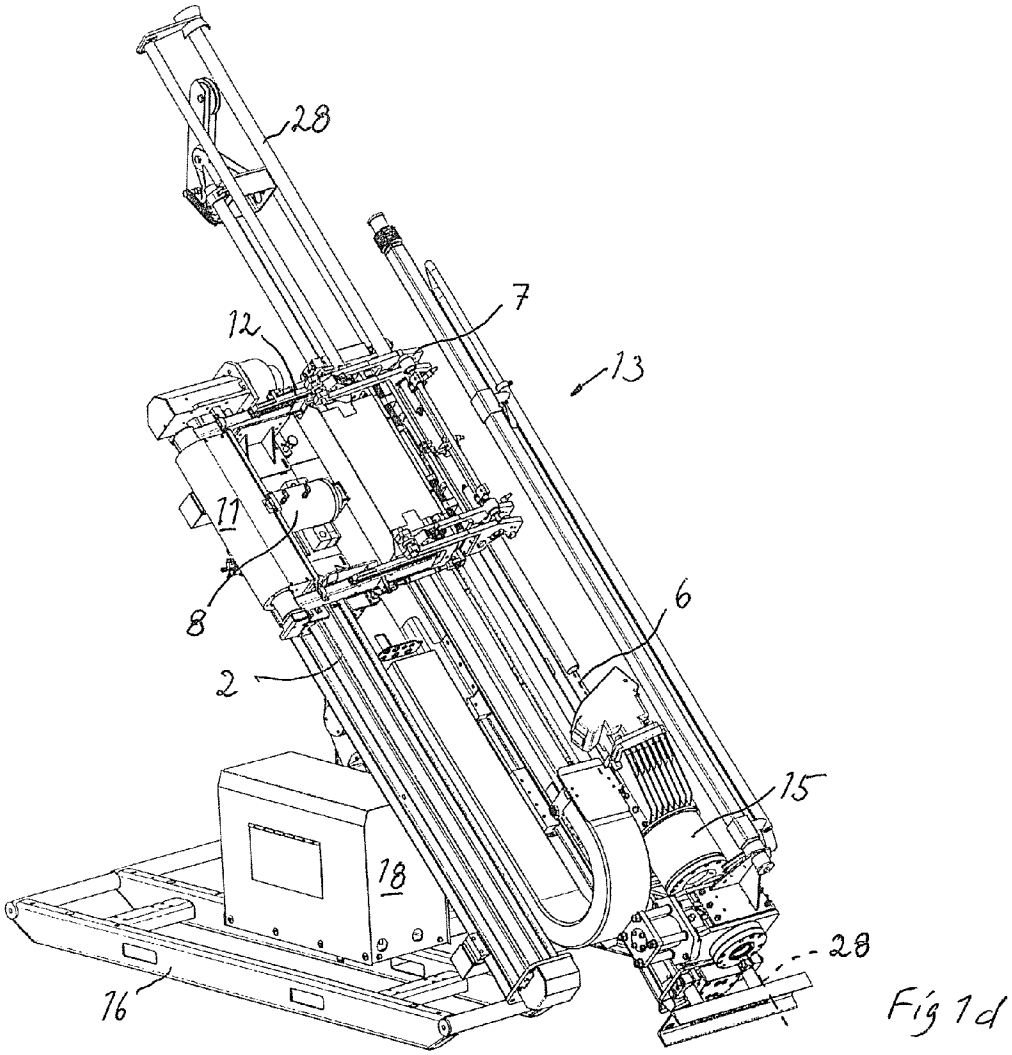

FIG. 1*c* shows the device after a part of swinging through the swing joint portion 10 such that the second link portion 12 together with the grip unit 7 is positioned in a vertical plane. In FIG. 1*c* has also been performed a further linear displacement of the slide 3 along the length guide 2 in the direction towards the upper end thereof.

FIG. 1*d* shows the device after the remaining part of the swinging through the swing joint portion 10 such that the grip unit is brought into the second position 6, where the drill string component 28 is coaxial with the drill string in the drilling machine and is ready for threading into an upper (not shown) drill string component held by the drilling machine. From FIG. 1*d* it is clear that the second link portion 12 is swingable to the extent that the swing joint portion 10 and the grip unit 7 are positioned on either side of the rotational actuator 8 in said second position. In particular is illustrated that the construction as a frame allows that the second link portion 12 is swung such that it surrounds the rotational actuator 8 in the second position such that the rotational actuator is inside the frame and thereby is not an obstruction against this movement by the swing unit 4.

The swing joint portion 10 is arranged most outwardly in the first link portion 11 which is shown, and is preferably a transversal frame part in the frame formed by the swing unit 4. As is illustrated by the Figures, the first link portion 11 is constructed in the form of a link extending in opposite direction from the axis of rotation 9 of the rotational actuator 8 (such that together with an axis of the rotational actuator 8 it can be said to have T-shape) and which has linear extension which altogether gives stability and rigidity to the swing unit. This in combination with the swing axis S (see FIG. 2*a*) of the swing joint portion 10 being parallel with a general extension of the first link portion gives an advantageous accessibility of the swing unit in both directions for its area of operation.

During the swing movement the swing portion 10 thus performs a swinging motion from a position outside of the drill rig to said second position when the drill string component is brought in for subsequent threading together with the rest of the drill string components 28. The three movement components rotation, linear displacement and swinging can suitably be partly overlapping such that they are at least partly performed simultaneously.

FIGS. 1*a-d* further show the rock drilling machine 15 belonging to the drill rig 13, a tube pack 17 between the principal drill rig and the device 1 on a supply side of the drill rig 13 for power supply of the drill rig, a power pack 18 which is connected to the drill rig 13 over the tube pack 17 and, on a free side of the drill rig 13, a protection gate 34.

This protection gate 34 is arranged for protecting the operator and other persons from the moveable parts of the drill rig. The protection gate is displaceable during standstills of the drill rig in order thereby to give free access to the drill rig, i.a. during handling of drill cores, which in a per se manner are regularly extracted through the drill string and picked out in a position behind the rock drilling machine, on the Figure above the rock drilling machine 15. The shown arrangement of the device 1 in respect of the principal drill rig 13, it is to be understood that the operator will have good access to the free side or the access side of the drill rig, for the unavoidable handling of extracted drill cores etc. The invention thus makes it possible that the device 1 for handling drill string components is positioned on the supply side of the drill rig, which gives this essentially free accessibility at the access side of the drill rig, which is a great advantage of the invention.

48 indicates a length driving device for the slide 3. 49 relates to an arrangement for core collecting inside the rig and is not subject of the present invention.

53 is a support device for support of a drill string component, in particular before it has been gripped in the first position. The support device 53 is fastened to an outermost region of the swing unit 4 over a support rod 52.

FIGS. 2*a-d* show the device 1 for handling drill string components freed from the drill rig in positions corresponding to the ones in FIGS. 1*a-d* for clarity reasons. It is referred to the above text for explanation of the positions and the components involved. 50 and 51 concerns fastening beams for fastening of the device 1 to the rig.

Figure 3:
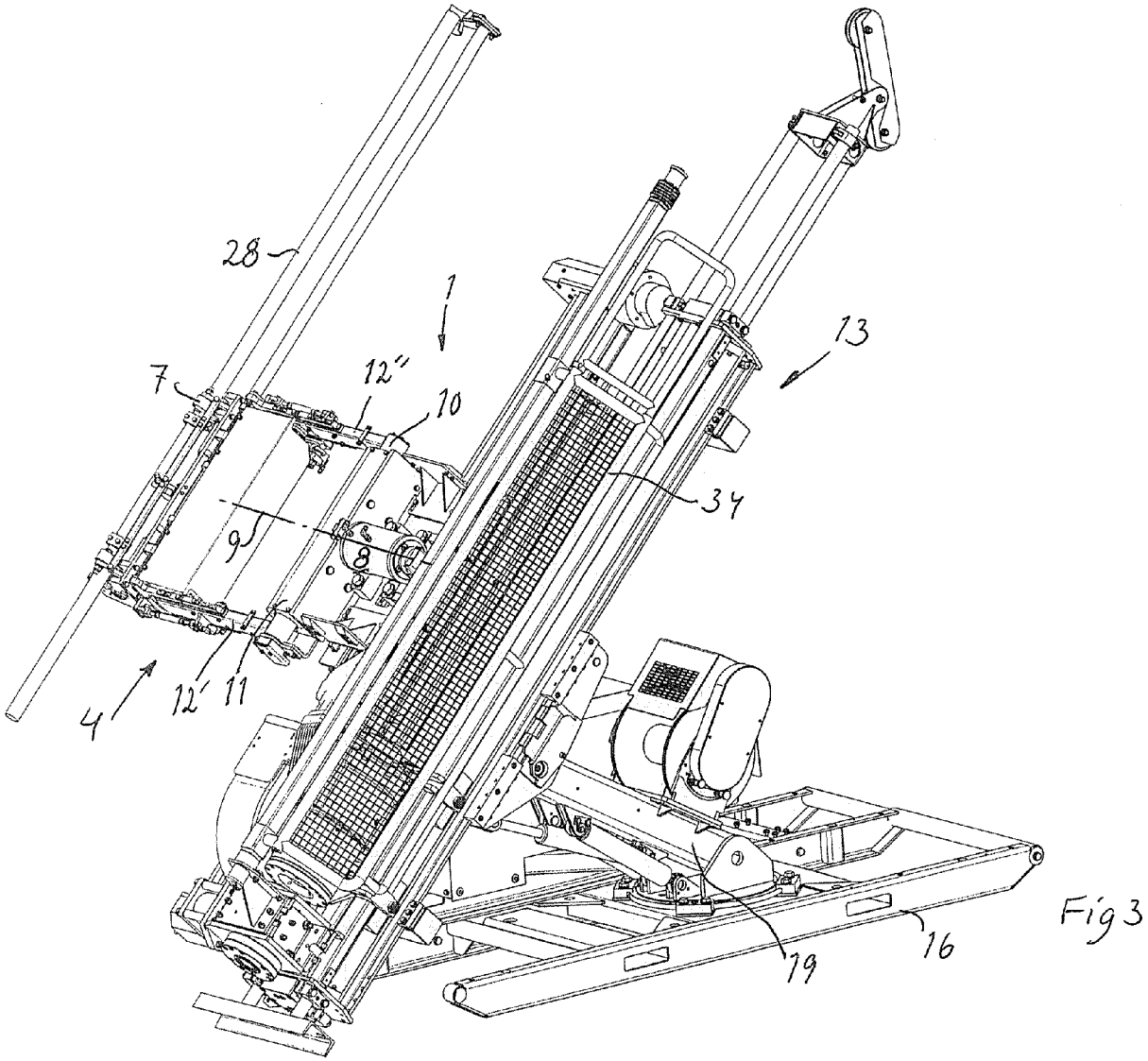
FIG. 3 shows the drill rig with the device for handling drill string components in FIGS. 1*a-d* in another perspective view.

In FIG. 3, the drill rig 3 is shown with a sideways arranged device 1 for handling drill string components according to the invention in a different view. This Figure more clearly shows the construction of the swing unit 4, with the first link portion 11 adjoining to the rotational actuator 8, wherein at the sideward ends of said link portion 11, over swing pins, there are fastened sideways arranged frame parts 12' and 12". At least in respect of one of these swing pins is arranged a rotation device 55 (indicated with interrupted lines in FIG. 4 and being included in the swing joint portion 10) for swinging the second link portion 12 in respect of the first link portion 11 over the swing joint portion 10.

Figure 2A:
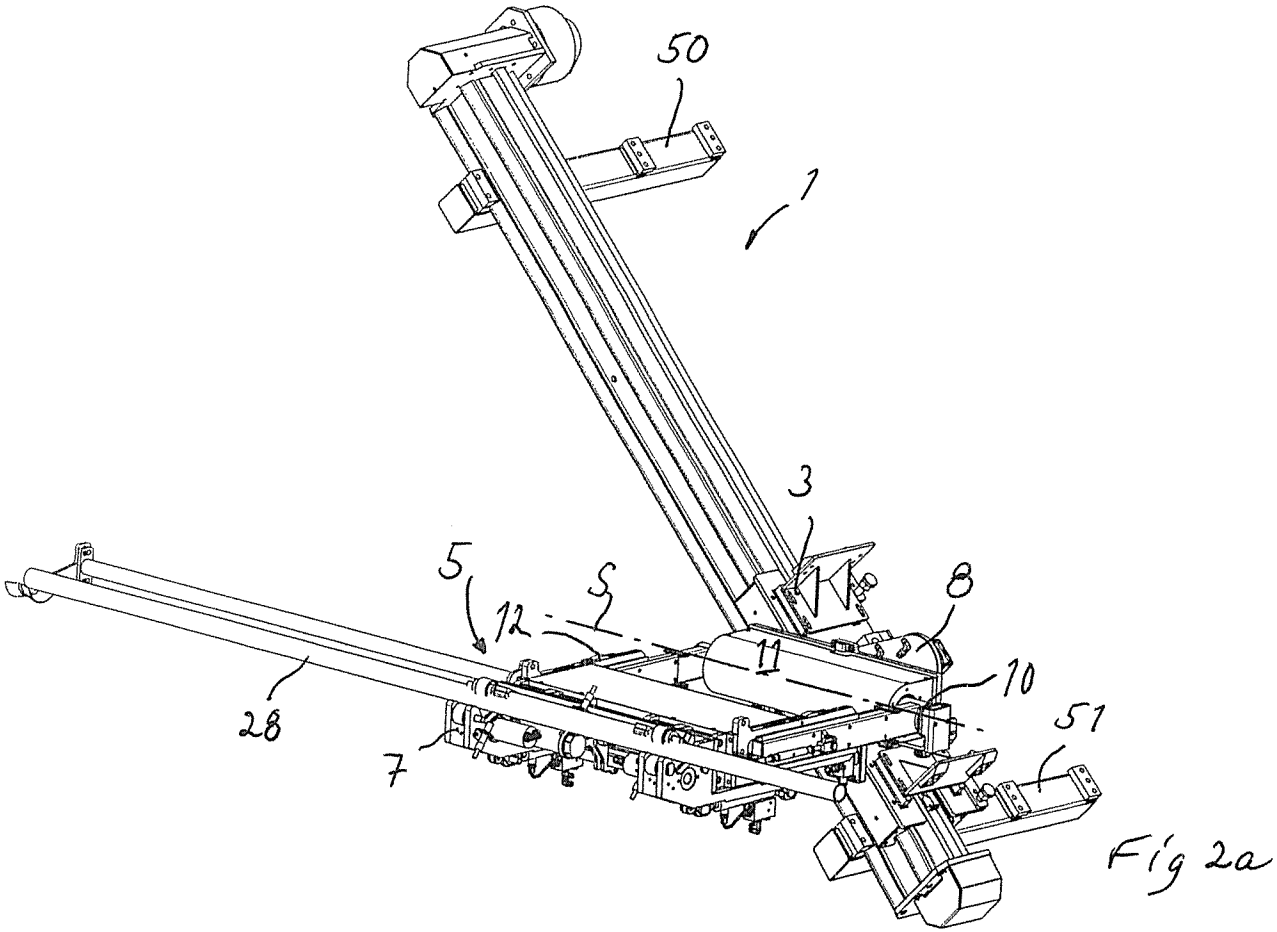
Figure 26:
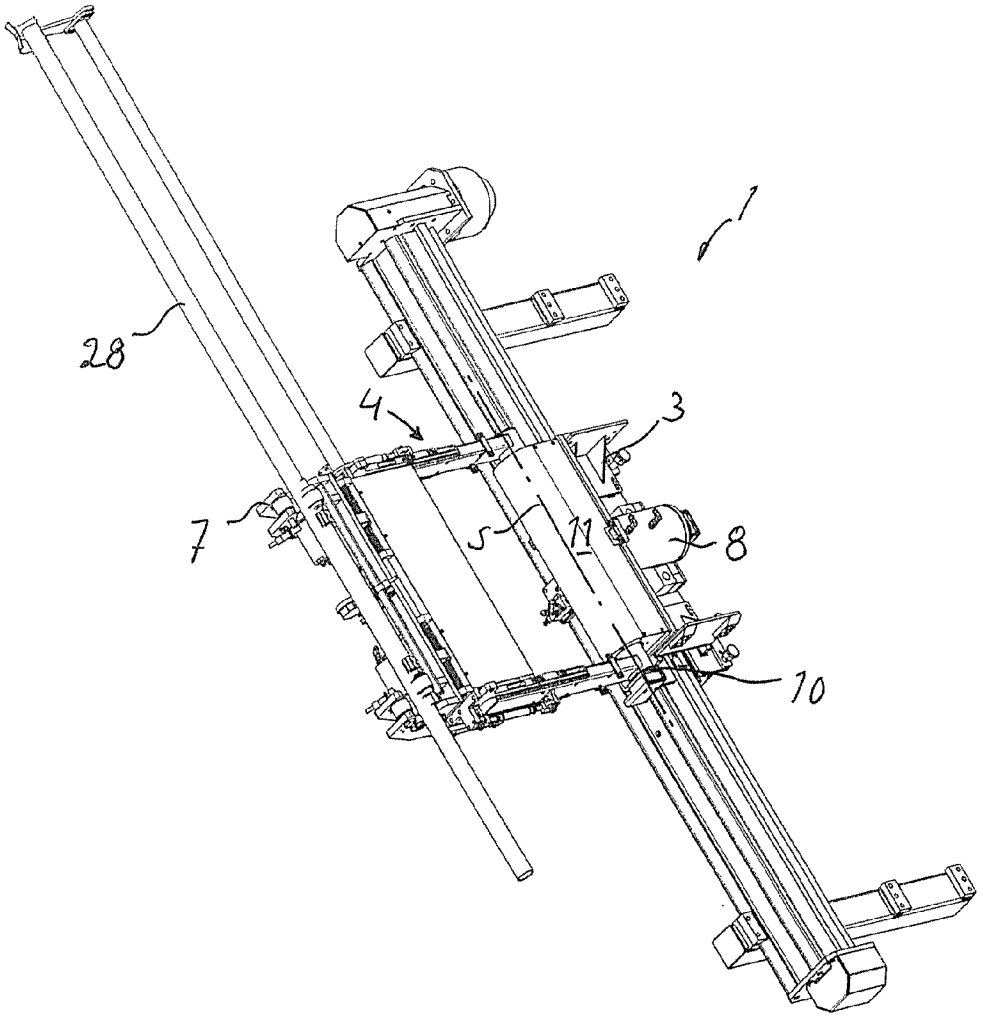
Figure 2C:
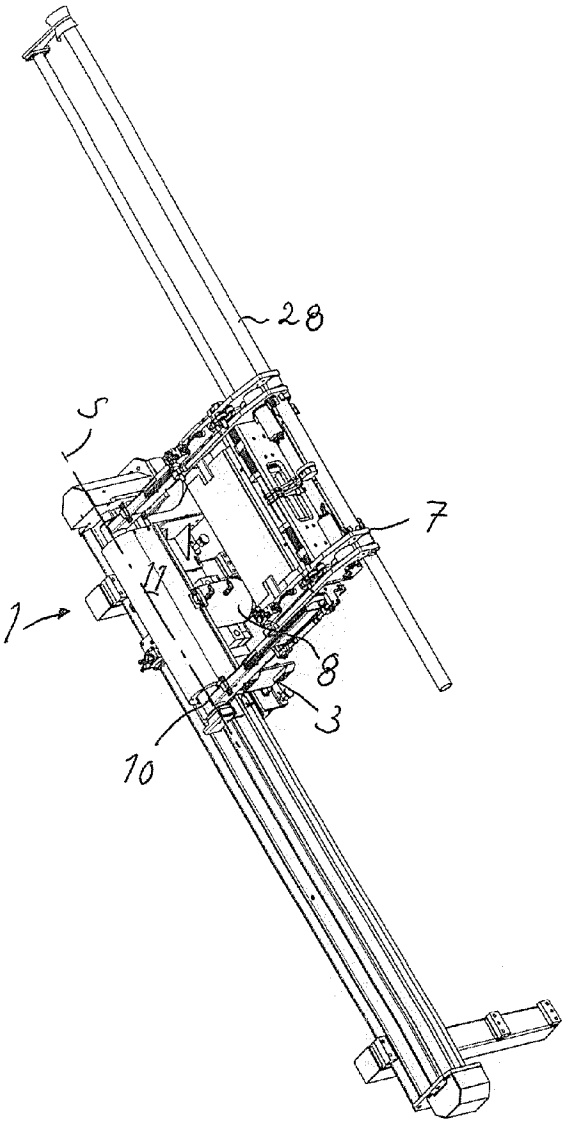
Figure 2D:
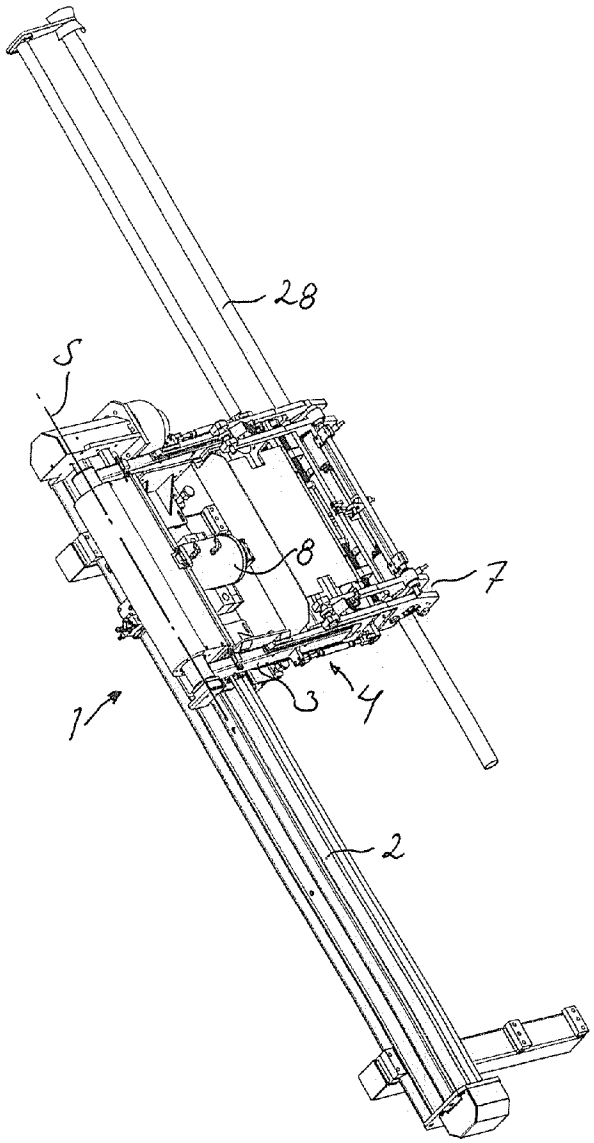

Through the construction as a frame of the second link portion 12, as is mentioned above, it surrounds the rotational actuator 8 in said second position, see FIG. 2*d*. The rotation actuator will thus not prevent the swing unit from swinging the grip unit to a region adjacent to the rear side of the rotational actuator, opposite to the outgoing axis of rotation, which is a great advantage and gives freedom to obtain an advantageous movement pattern.

FIG. 3 shows the drill rig supported by the stand 16, which also supports an angle adjustment arrangement 19 of the drill rig. Through the angle adjustment arrangement 19, the drill rig can be adjusted for drilling in different directions such as angled downwardly (towards a supporting ground, as is shown in FIG. 3) sideways (towards for example a wall in a gallery) and also upwardly (towards for example the roof of a gallery).

The inventive device 1 can easily be adjusted such that the grip unit is always horizontal in the first position of the swing unit 4 (corresponding to what is shown in FIGS. 1*a* and 2*a*) for receiving and delivering of drill string components beside the drill rig 13 and such that it is still capable of delivering a gripped drill string component in the second position, irrespectively the setting of the drill rig for drilling in different directions. This can be accomplished by setting parameters of the rotational actuator 8.

Figure 4:
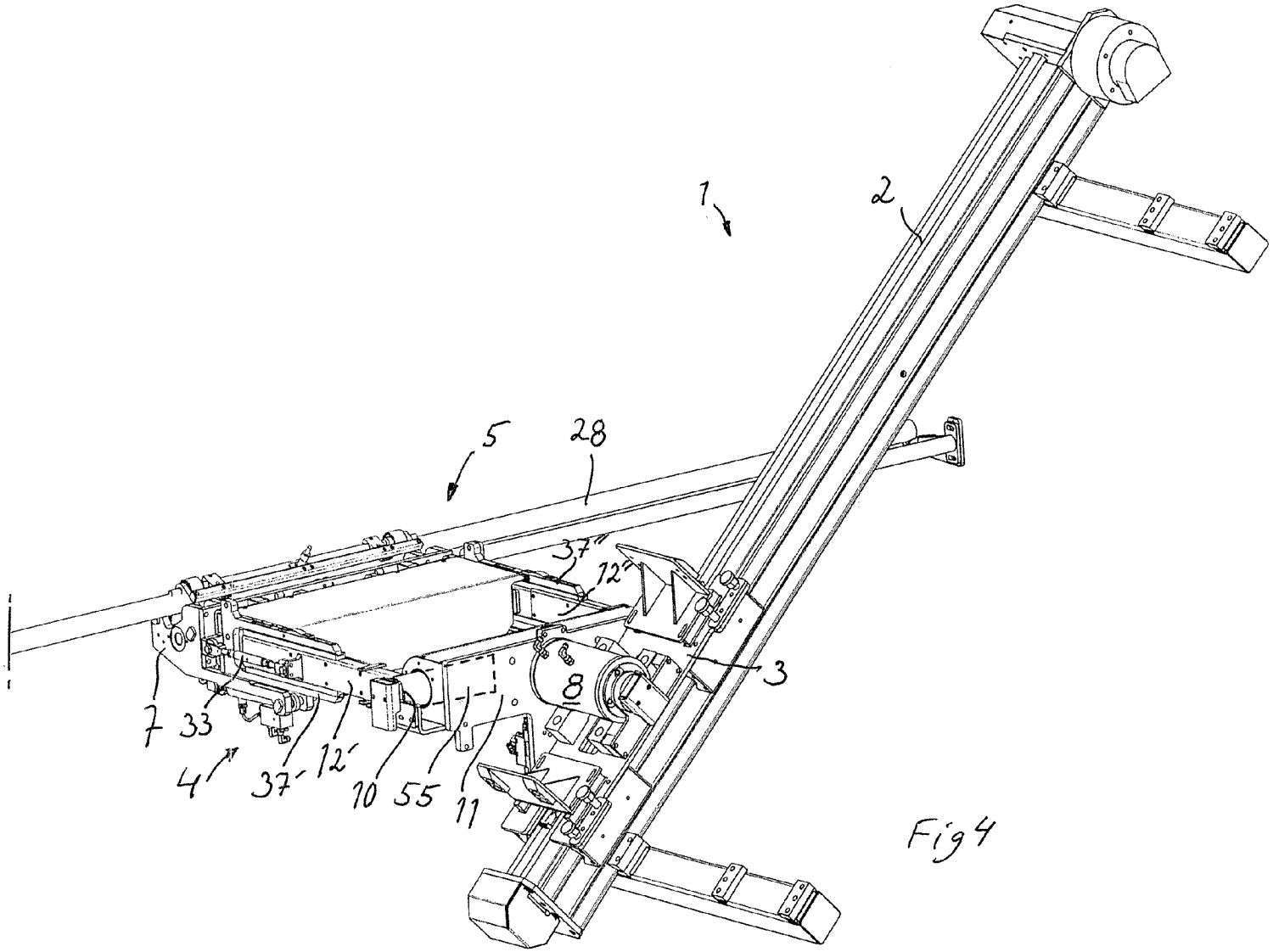
FIG. 4 shows the device in FIGS. 2*a-d* in another perspective view.

FIG. 4 shows a different view of the device 1. It should be noted that on the shown embodiment, there is an arrangement for length adjustment of the second link portion 12 for fine adjustment of the position of the grip unit in the second position for assembling and disassembling of drill string components in the drill rig.

Said device for length adjustment includes an arrangement having possibilities of parallel displacement of a frame part 36 being including in the second link portion (see FIG. 5*a*) in respect of the first link portion 11 by way of a screw arrangement 33 (see FIG. 4) corresponding to a turnbuckle arrangement.

Figure 5B:
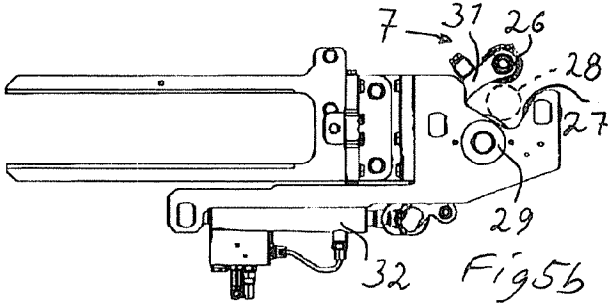
FIGS. 5*a-c* show in detail a gripper arrangement and the floating suspension thereof in different views.
Figure 5A:
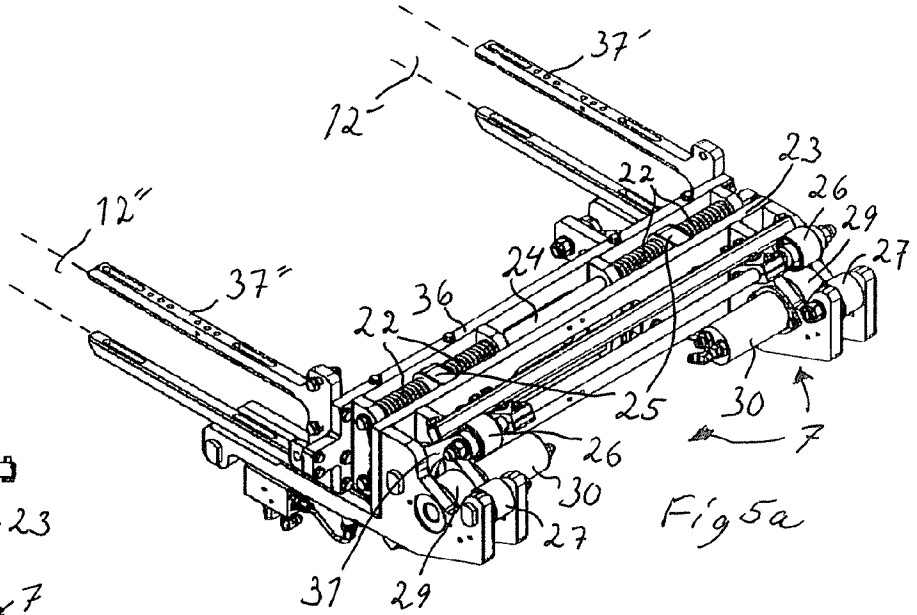
Figure 5C:
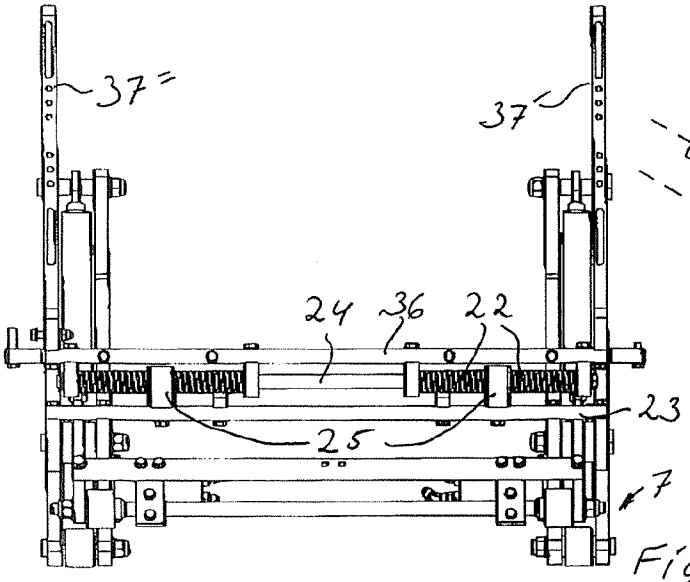

FIGS. 5*a-c* show the swing unit 4 and in particular the second link portion 12 having sideways arranged frame parts 12' and 12" (indicated with interrupted lines in FIG. 5*a*) together with a transversal frame part 36. On each one of the sideways arranged frame parts 12' and 12" there is displacingly arranged support frame portions 37' and 37", that slidingly cooperate with the sideways arranged frame parts 12' and 12". FIGS. 5*a-c* show in an embodiment that the support frame parts 37' and 37" in a forklike manner encloses portions of the sideways arranged frame parts 12' and 12". Alternative adjustment possibilities of per se known kind can be provided.

In the outermost area of the sideways arranged frame parts 12' and 12", there can be a stabilizing transversal auxiliary frame part (not shown).

In the outermost transversal frame part 36, there is floatingly suspended an arrangement with a grip unit 7 which includes a number of support rollers 26, 27, 29 for a drill string component 28 which is to be handled with the device according to the invention. 26 indicates a pair of grip rollers being moveable on levers 31, said grip rollers cooperating with a pair of fixed grip rollers 27 as well as a pair of actuation rollers 29, which in turn are actuated by a pair of rotator devices in the form of actuators 30 being shown in FIG. 5*a*. 32 indicates a hydraulic cylinder device for maneuvering the lever 31. A corresponding hydraulic cylinder is arranged on the opposite side of the device. During gripping of a drill string component 28 the levers are swung inwardly with the moveable grip rollers 26 to the position shown in FIG. 5*a*.

The grip unit 7 is floatingly suspended at the outermost part of the swing unit 4, here shown on the outermost, transversal frame part 26 thereof, in such a way that a pair of parallel linear guiding rods 24, whereof one is shown in FIG. 5*a*, allows a linear displacement of the grip unit 7 in the longitudinal direction of the linear guiding rod. From a body portion 23 of the grip unit 7 body ears 24 extend, which over holes are slideable on the linear guide rods 24, and on opposite sides of which pressure springs 22 are being arranged for allowing linear movement along the linear guide rods 24 against the action of the spring force of said springs 22.

In operation of a device this means that an external pressure against the grip unit 7 in a direction in parallel with an axial direction of a gripped drill string component 28 (indicated through interrupted lines in FIG. 5*b*) an in parallel with the linear guiding rods 24 results in a resilient linear moment because of the resiliency of the springs 22. This way the grip unit 7 will be provided a floating suspension at the end of the spring unit 4 in directions in parallel with a gripped drill string component, with a general extension of the first link portion 11 and with the swing axis S of the swing joint portion 10 at the first link portion 11.

This is of great importance for an effective assembling and disassembling of drill string components in the drill rig. After swinging-in of a drill string component 28 to said second position in the drill rig, the drill string component is rotated by the grip unit through initiation of the rotation device (devices) 30 of the drive roller (rollers) 29. The slide 3 is thereby brought forward in a forward direction such that the forward thread of the gripped drill string component 28 intended for assembling goes into engagement with the rear thread of a drill string component being held by the rock drilling machine 15. The floating suspension of the grip unit 7 now allows a smooth movement and an exact adjustment of the position of the gripped and rotated drill string component for the threads to enter in an advantageous manner for achieving an impeccable threading together of the drill string.

It shall here be noted that the axes of all support rollers at the grip unit including the grip rollers 26 being moveable on the levers 31, the fixed grip rollers 27 and the drive rollers 29 are parallel to an axial direction of the gripped drill string components. Hereby the linear drive of the slide can be used for the process of threading together, which is an advantage since, because of the floating suspension, the device can be useful for drill string components with varying pitch without special accurate adjustment. It can be mentioned that no axial displacement of drill string components result from the very operation of the drive rollers 29.

Figure 6:
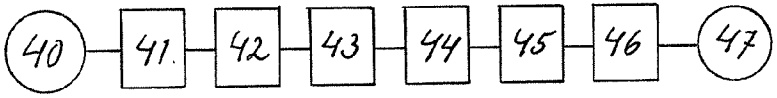
FIG. 6 shows diagrammatically a method sequence according to the invention.

A method for handling drill string components 28 of a drill rig 13 is described with the aid of FIG. 6:

Position 40 indicates the start of the sequence.

Position 41 indicates positioning of a drill string component 28 in the grip unit in the first position and activating the grip unit 7 for gripping the drill string component.

Position 42 indicates rotation of the grip unit with a gripped drill string component by means of a rotational actuator being supported by the slide into a position where the drill string component is parallel to the drill string position in the drill rig.

Position 43 indicates longitudinal displacement of the grip unit 7 by means of the to and fro moveable slide 3 in a direction towards an upper end of its longitudinal guide. This measure is possibly superfluous if loading etc. in the first position can be accomplished at the same length displacement position of the slide as bringing it into/from the drill rig in the second position.

Position 44 indicates swinging of the grip unit to the second position with the gripped drill string component 28 by means of the swing unit.

Position 45 indicates longitudinal displacement of the grip unit 7 through the to and fro moveable slide 3 in a direction towards the drilling machine 15 during rotation of the gripped drill string component in said second position for threading together drill string components.

Position 46 indicates verifying completed sequence.

Position 47 indicates the end of the sequence.

As is indicated above, the measures in Position 42, 43 and 44 may (at least partly) overlap. The measures in Position 42 and 43 can be in reverse order if it is suitable.

The invention has been described at the background of inserting of new drill string component. It is clear for the person skilled in the art that the corresponding method essentially reversed is used during extracting drill string components from the rig.

The invention can be varied within the scope of the patent claims and the components involved can be constructed otherwise than what is described above supported by the embodiments. It is not excluded that for example the device is used for other rigs than core drill rigs. It is preferred that the swing unit has frame shape as is described above, but it is not excluded that it is design with simple link arms with the same swing pattern as is described for the swing unit above, even if this is not preferred because of i.a. stability reasons.

The device according to the invention includes preferably a control unit (CPU in FIG. 1*a*), which can be in common with or separate from the control system of the rig, and which is connected to at least any one from the group: position sensors and rotation sensors, for detecting of positions taken by moveable components and initiating of control sequences guided therefrom.

The invention claimed is:

1. A device for handling drill string components for a drill rig, the device comprising:

a longitudinal guide, a slide displaceably arranged on the longitudinal guide, a grip unit being supported by the slide and comprising a rotator unit configured to rotate a gripped drill string component, a swing unit configured to swing the grip unit between a first position lateral to the slide for receiving and delivering of drill string components beside the drill rig and a second position for assembling and disassembling of drill string components in the drill rig, and a rotational actuator being operatively connected to the slide and having an axis of rotation forming an angle to a longitudinal axis of the longitudinal guide, wherein the rotational actuator is configured to rotate the grip unit and the swing unit, wherein the swing unit includes a first link portion which is operatively connected to said rotational actuator, such that the rotational actuator is arranged between the slide and the swing unit, a second link portion, which is operatively connected to the grip unit, and a swing joint portion, which interconnects said first link portion and the second link portion for swinging the second link portion with respect to the first link portion, wherein the swing joint portion is configured to swing the second link portion and the grip unit with respect to the first link portion from the first position to the second position, wherein the first link portion comprises a first frame part extending perpendicular to said rotational axis, wherein the second link portion includes two sideways arranged frame parts and a transversal frame part, and wherein the swing joint portion includes a rotation device configured to swing the second link portion with respect to the first link portion.

2. The device according to claim 1, further comprising:

a resilient portion arranged between the slide and the grip unit for allowing relative movement between the slide and the grip unit in directions that are parallel with an axial direction of a gripped drill string component.

3. The device according to claim 2, wherein the resilient portion is arranged between the second link portion and a body portion of the grip unit.

4. The device according to claim 3, wherein the resilient portion includes a linear guide and a spring pack acting between the second link portion and the body portion.

5. The device according to claim 1, wherein the rotation axis of the rotational actuator extends at a right angle to the longitudinal axis of the longitudinal guide.

6. The device according to claim 1, wherein the swing joint portion includes two swing pins extending from the first frame part, and wherein at least one of the swing pins is drivable by the rotation device.

7. The device according to claim 1, wherein the second link portion is swingable such that the swing joint portion and the grip unit are positioned on either side of the rotational actuator in said second position.

8. The device according to claim 1, wherein the construction as a frame allows the second link portion to be swung such that the second link portion surrounds the rotational actuator in said second position.

9. The device according to claim 1, wherein the second link portion is length adjustable.

10. The device according to claim 1, wherein said rotator unit includes a plurality of support rollers for cooperation with a gripped drill string component, wherein at least one of the support rollers is drivable, the axes of which being parallel to an axial direction of a gripped drill string component.

11. The device according to claim 1, further comprising:

a control unit, which is interconnected with at least one from the group: position sensors or rotation sensors, for detecting positions taken by moveable components of the device and initiation of control sequences guided thereby.

12. A method for handling drill string components for a drill rig, the method comprising:

swinging, with a swing unit comprising a flame, a grip unit into a first position for receiving the drill string components beside the drill rig, longitudinally displaces the grip unit through a to and fro moveable slide a longitudinal guide, rotating said grip unit with the gripped drill string component with a rotational actuator being operatively connected to the slide and having a rotational axis around an axis of rotation, which forms an angle with a longitudinal axis of the longitudinal axis of the longitudinal guide, the rotational actuator being arranged between the slide and the swing unit; and swinging the grip unit with the gripped drill string component with the swing unit utilizing a swing joint which interconnects a first link portion of the swing unit being operatively connected to said rotational actuator and comprising a first frame part extending perpendicular to the rotational axis, and a second link portion of the swing unit being operatively connected to the grip unit and including two sideways arranged frame parts and a traversal frame part, such that the swing unit swings the second link portion with respect to the first link portion from the first position lateral to the slide to a second portion utilizing the swing joint portion, thereby arranging the grip unit into the second position for assembling and disassembling of drill string components, wherein the swing joint portion includes a rotation device configured to swing the second link portion with respect to the first link portion.

13. The method according to claim 12, further comprising:

a relative movement between the slide and the grip unit in directions in parallel with an axial direction of the gripped drill string component through a resilient portion being arranged between the slide and the grip unit.

14. The method according to claim 12, wherein said grip unit with the gripped drill string component is rotated around the axis of rotation extending at a right angle to the longitudinal axis of the longitudinal guide.

15. The method according to claim 12, wherein the second link portion swings such that the swing joint portion and the grip unit are positioned on either side of the rotational actuator in said second position.

16. The method according to claim 12, wherein rotation of the gripped drill string component is accomplished through a plurality of support rollers, wherein at least one of the support rollers is drivable, wherein axes of the support rollers are in parallel with an axial direction of a gripped drill string component.

17. The method according to claim 12, wherein rotation of the grip unit and swinging of the grip unit at least partly overlap each other.

18. A drill rig, comprising:

a linear guide;

a to and fro displaceable rock drilling machine; and a device for handling drill string components, the device comprising a longitudinal guide, a slide displaceably arranged on the longitudinal guide, a grip unit being supported by the slide and comprising a rotator unit configured to rotate a gripped drill string component, swing unit configured to swing the grip unit between a first position lateral to the slide for receiving and delivering of drill string components beside the drill rig and a second position for assembling and disassembling of drill string components in the drill rig, and a rotational actuator being operatively connected to the slide and having an axis of rotational formation an angle to a longitudinal axis of the longitudinal guide, wherein the rotational actuator is configured to rotate the grip unit and the swing unit, wherein the swing unit includes a first link portion which is operatively connected to said rotational actuator, such that the rotational actuator is arranged between the slide and the swing unit, a second link portion, which is operatively connected to the grip unit and a swing joint portion, which interconnects said first link portion and the second link portion for swinging the second link portion with respect to the first link portion, wherein the swing joint portion is configured to swing the second link portion and the grip unit with respect to the first link portion from the first position to the second position, wherein the first link portion comprises a first frame part extending perpendicular to said rotational axis, wherein the second link portion includes two sideways arranged frame parts and a transversal frame part, and wherein the swing joint portion includes a rotational device configured to swing the second link portion with respect to the first link portion.

* * * * *